US008514144B2

(12) United States Patent
Gray et al.

(10) Patent No.: US 8,514,144 B2
(45) Date of Patent: Aug. 20, 2013

(54) ANTENNA SYSTEM AND CONNECTOR FOR ANTENNA

(75) Inventors: Jimmie D. Gray, Allen, TX (US); John Breitzmann, Richardson, TX (US); Charles T. Lambe, Grand Prairie, TX (US)

(73) Assignee: Jim D. Gray & Associates, Inc., Richardson, TX (US)

( * ) Notice: Subject to any disclaimer, the term of this patent is extended or adjusted under 35 U.S.C. 154(b) by 355 days.

(21) Appl. No.: 12/847,296

(22) Filed: Jul. 30, 2010

(65) Prior Publication Data

US 2011/0025580 A1 Feb. 3, 2011

Related U.S. Application Data

(60) Provisional application No. 61/229,772, filed on Jul. 30, 2009.

(51) Int. Cl.
*H01Q 1/24* (2006.01)

(52) U.S. Cl.
USPC ..... 343/892; 343/718; 343/895

(58) Field of Classification Search
USPC ..... 343/892, 702, 718, 888–890, 895, 343/900
See application file for complete search history.

(56) References Cited

U.S. PATENT DOCUMENTS

| | | | | |
|---|---|---|---|---|
| 5,349,365 | A | 9/1994 | Ow et al. | |
| 6,552,693 | B1 | 4/2003 | Leisten | |
| 7,002,530 | B1 | 2/2006 | Chung et al. | |
| 7,180,472 | B2 | 2/2007 | Yegin et al. | |
| 7,245,268 | B2 * | 7/2007 | O'Neill et al. | 343/895 |
| 7,439,934 | B2 | 10/2008 | Leisten et al. | |
| 7,489,281 | B2 * | 2/2009 | O'Neill et al. | 343/822 |
| 7,528,796 | B2 | 5/2009 | Leisten et al. | |
| 2004/0052144 | A1 | 3/2004 | Berens et al. | |
| 2004/0104683 | A1 | 6/2004 | Leung et al. | |
| 2006/0264102 | A1 | 11/2006 | Poilasne | |
| 2007/0252764 | A1 | 11/2007 | Keski-Opas | |

OTHER PUBLICATIONS

International Search Report dated Sep. 21, 2010 for PCT/US2010/043895 counterpart application.

Webpages from http://chinmore.manufacturer.globalsources.com; accessed Jul. 21, 2009; pp. 1-2.

Webcom Communications Corp., Antenna Systems and Technology, Simulation Helps Sarantel Design World's Smallest Quadrifilar Helix Antenna, Copyright Date 2007, p. 1.

* cited by examiner

*Primary Examiner* — Daniel D Chang
(74) *Attorney, Agent, or Firm* — Grady K. Bergen; Griggs Bergen LLP

(57) ABSTRACT

A connector for an RF antenna for coupling the RF antenna to a device is formed from a base. A collar is provided for receiving and coupling to an RF antenna. A coupling structure extends from the base and engages the device to facilitate coupling of the antenna to the device. An antenna system is also formed from an RF antenna and a device to which the RF antenna couples and for which the RF antenna is used. The antenna system further includes a connector formed from a base, a collar for receiving and coupling to the RF antenna and a coupling structure that extends from the base and engages the device to facilitate coupling of the antenna to the device.

20 Claims, 9 Drawing Sheets

ANTENNA SYSTEM AND CONNECTOR FOR ANTENNA

CROSS-REFERENCE TO RELATED APPLICATIONS

This application claims the benefit of U.S. Provisional Application No. 61/229,772, filed Jul. 30, 2009, which is incorporated herein by reference in its entirety.

BACKGROUND

The present invention relates to antennas and antenna systems. In particular, the invention may relate to global positioning system (GPS) and satellite phone antennas and similar antennas and antenna systems. In prior art antennas, the antennas are typically coupled to a circuit board directly through feed pins of the antenna itself, which are soldered to the pads of the circuit board or coupled to the circuit board with which the antenna is used. To mount the antenna it is often times difficult to hold the antenna in place to ensure that the pins are properly aligned while it is soldered in place. Additionally, once soldered together, the feed pins are the only means for holding the antenna to the circuit board and are prone to breakage or bending. Accordingly, the present invention serves to overcome these shortcomings.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

The present invention is directed to a connector and an antenna system utilizing a connector wherein the connector facilitates the coupling of an antenna to various structures, such as a printed circuit board (PCB) of electronic devices receiving and/or transmitting radio frequency signals. In particular, the connector is used for coupling high-frequency antenna systems, which are defined herein as those having a frequency in excess of 200 MHz. In particular, the connector and antenna system may have application to those used in transmitting and/or receiving radio signals in GPS devices and in satellite telephones, such as those used with the Iridium satellite system. The connector and antenna system may have application to other systems as well.

GPS devices typically operate at frequencies in the range of about 1000 MHz to about 2000 MHz. Satellite telephones typically operate at higher frequencies in the range of about 1500 MHz to about 2500 MHz. Although the connector and antenna system is shown and described for use with GPS devices and satellite telephones, it may have application to other devices that utilize antennas or antenna systems that operate at similar or different radio frequencies, as well.

It should be noted in the description, if a numerical value or range is presented, each numerical value should be read once as modified by the term "about" or "approximately" (unless already expressly so modified), and then read again as not so modified unless otherwise indicated in context. Also, in the description, it should be understood that an amount range listed or described as being useful, suitable, or the like, is intended that any and every value within the range, including the end points, is to be considered as having been stated. For example, "a range of from 1 to 10" is to be read as indicating each and every possible number along the continuum between about 1 and about 10. Thus, even if specific points within the range, or even no point within the range, are explicitly identified or refer to, it is to be understood that the inventor appreciates and understands that any and all points within the range are to be considered to have been specified, and that inventor possesses the entire range and all points within the range.

Figure 1:
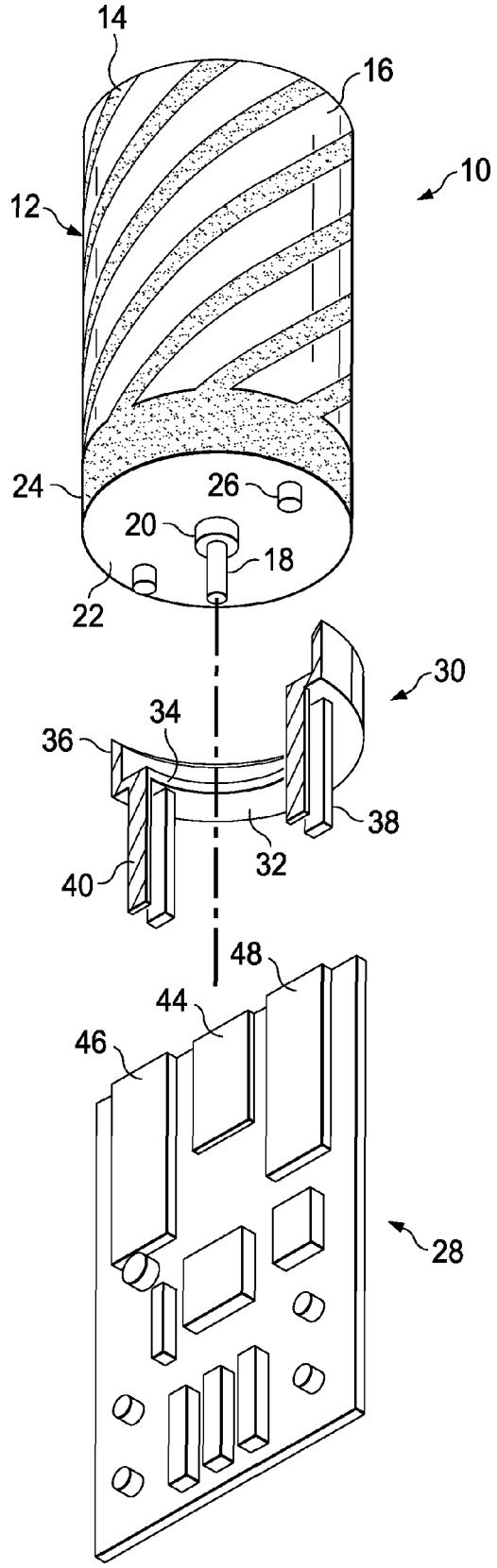
FIG. 1 is a front elevational view of an antenna device showing components of the device exploded apart, and shown with an end-mount antenna connector of the invention in cross section.

Referring to FIG. 1, an example of an antenna 10 is shown that may be used with the connector described herein. For the example, the antenna 10 is shown as a quadrifilar helical antenna (QHA), which is commonly used in GPS and satellite phones, the construction of which are well known to those skilled in the art. Non-limiting examples of such antennas are described in U.S. Pat. Nos. 6,552,693; 7,439,934 and 7,528,796, which are each incorporated herein by reference in their entireties for all purposes. It should be further apparent to those skilled in the art that although throughout this disclosure reference is made to a cylindrical quadrifilar helical antenna, other antennas having similar or different configurations, cylindrical and non-cylindrical, may be used as well and are intended to be encompassed by and within the scope of the invention.

The antenna 10 is shown as a conventional QHA antenna having a main body 12 that is generally cylindrical in shape and has generally uniform circular transverse cross section along its length. The outer surface of the antenna 10 may be provided with two or more helical filars or elements 14 formed from an electrically conductive material (e.g. copper) that surround a dielectric core 16, which may be formed from ceramic or other dielectric materials. For the QHA antenna there are four filars or elements 14.

The core 16 houses an axially extending feed conductor or pin 18, a portion of which may be encased in an insulated sleeve 20, and which projects from the proximal end 22 of the body 12. The feed pin 18 may be used to electrically couple the antenna 10 to circuitry of devices for which the antenna 10 is used.

A ground conductor 24 in the form of a conductive sleeve formed on the exterior of the proximal end of the cylindrical body 12 may be connected to the elements 14. A pair of projecting lugs, pins or contacts 26 are provided on the proximal end face of the body 12 and are shown positioned on either side of the feed pin 18. The contacts 26 may be used to electrically couple the antenna 10 to ground circuitry of devices for which the antenna 10 is used, such as the circuit board 28. As will be seen, however, in some embodiments the contacts 26 may be eliminated due to the configuration of the connector, as described herein.

A connector 30 is shown that may be used with the antenna 10 or other antenna systems. All or a portion of the connector 30 may be formed from an electrically conductive material, such as various conductive metals or metal alloys (e.g. copper, brass, nickel, chrome, gold, etc.). All or a portion of the connector 30 may be plated or coated with an electrically conductive material, with other portions being conductive or non-conductive. This may include a non-conductive connector body with the surfaces of the connector body being plated or coated with a conductive material. In certain embodiments, a gold, nickel or other plating or coating may provided on the connector 30. The coating may be from about 1 microns to about 10 microns, more particularly from about 3 to 6 microns, and still more particularly from about 3.5 to 5.5 microns. As an example, the connector 30 may be formed from brass with about 5 micron of gold flash plating on its surfaces. The metal coating may provide enhanced conductivity, prevent corrosion, facilitate soldering, etc. The connector 30 may be molded or formed from a unitary piece of material or may be formed from several components that are assembled together. In the embodiment of FIG. 1, the connector 30 is shown as an end-mount connecter for mounting the antenna 10 on the end or edge of a circuit board, such as the circuit board 28, wherein the longitudinal axis of the connector 30 and antenna 10 may be oriented generally parallel to the plane of the circuit board 28. The connector 30 is provided with a generally flat, circular base 32 having a generally central opening 34, which may be circular and concentric with the base. The opening 34 may have a non-circular configuration as well and be non-centrally located in certain embodiments but may otherwise be configured to receive the feed pin 18 or other components of the antenna 10 necessary for its functioning. A cylindrical wall 36 extends upward generally from the perimeter of the base 32 and forms a collar of the connector 30. The base 32 and collar 36 may be sized and configured to closely receive the proximal end of the cylindrical antenna 10 with the feed pin 18 of the antenna projecting through the central opening 34.

Figure 2:
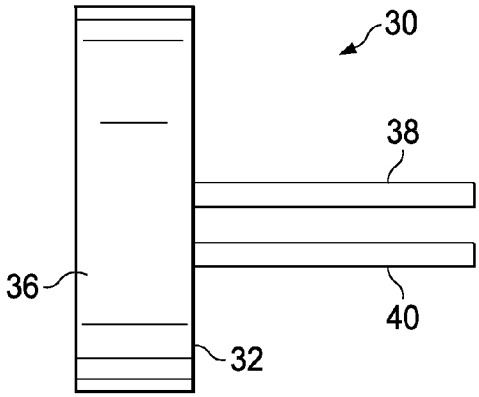
FIG. 2 is a left elevational side view of the antenna connector of FIG. 1.
Figure 3:
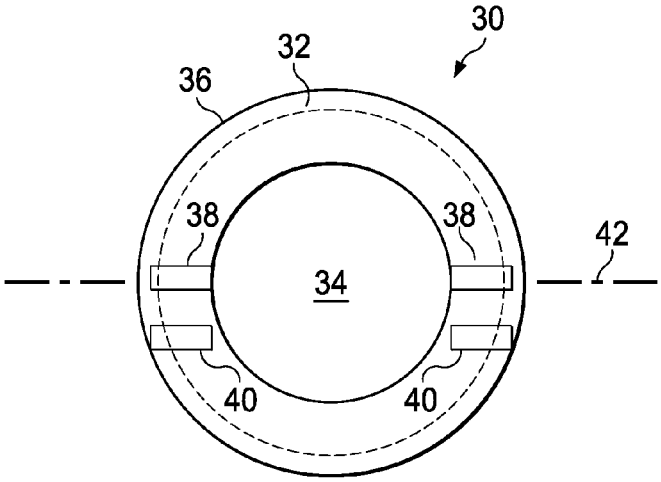
FIG. 3 is a bottom plan view of the antenna connector of FIG. 1.
Figure 4:
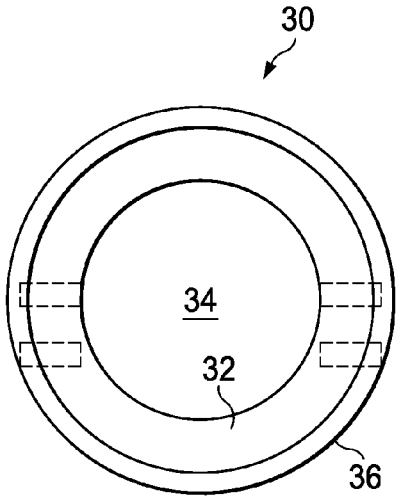
FIG. 4 is a top plan view of the antenna connector of FIG. 1.

Referring to FIGS. 2 and 3, extending from the lower surface of the base 32 are mounting legs or members 38, 40. In the embodiment shown, there are two sets of the mounting legs or members 38, 40 located on either side of the central opening 34. It can be seen that the members 38, 40 each have generally rectangular transverse and longitudinal cross sections that provide generally flat, parallel inwardly facing surfaces, although other shapes and configurations may also be used. In the embodiment shown, the legs 38, 40 are shown being spaced apart about either side of the central opening 34 with each leg 38 being generally aligned with a corresponding leg 40 so that they directly face one another. The legs 38 may be spaced apart from the legs 40 a distance to receive the circuit board 28 or other structure to which the antenna is to be mounted. For example, the legs 38, 40 may be spaced apart a distance to closely receive a circuit board having a thickness of about 0.031 inch or 0.062 inch, which are typical thicknesses of boards commonly employed with RF antennas, as are described herein.

As shown in FIG. 3, which is a bottom plan view of the connector 30, the inward faces of the legs 38 generally align with or are immediately adjacent to a centerline 42 of the connector that passes through the center of the opening 34. In the embodiment shown, the inward faces of the legs 38 may be slightly below the centerline. This provides a slight offset so that when mounted to a circuit board or other structure, the feed pin 18 may be precisely aligned or positioned to be in electrical contact with a pad 44 or other circuitry provided on the surface of the circuit board 28 or other structure of the antenna system or device with which the antenna is used. In other embodiments, the inward faces of the legs 38 may be located at, near or above or below the center line to provide the desired alignment of the feed pin 18 or other electrical contact of the antenna 10.

Figure 5:
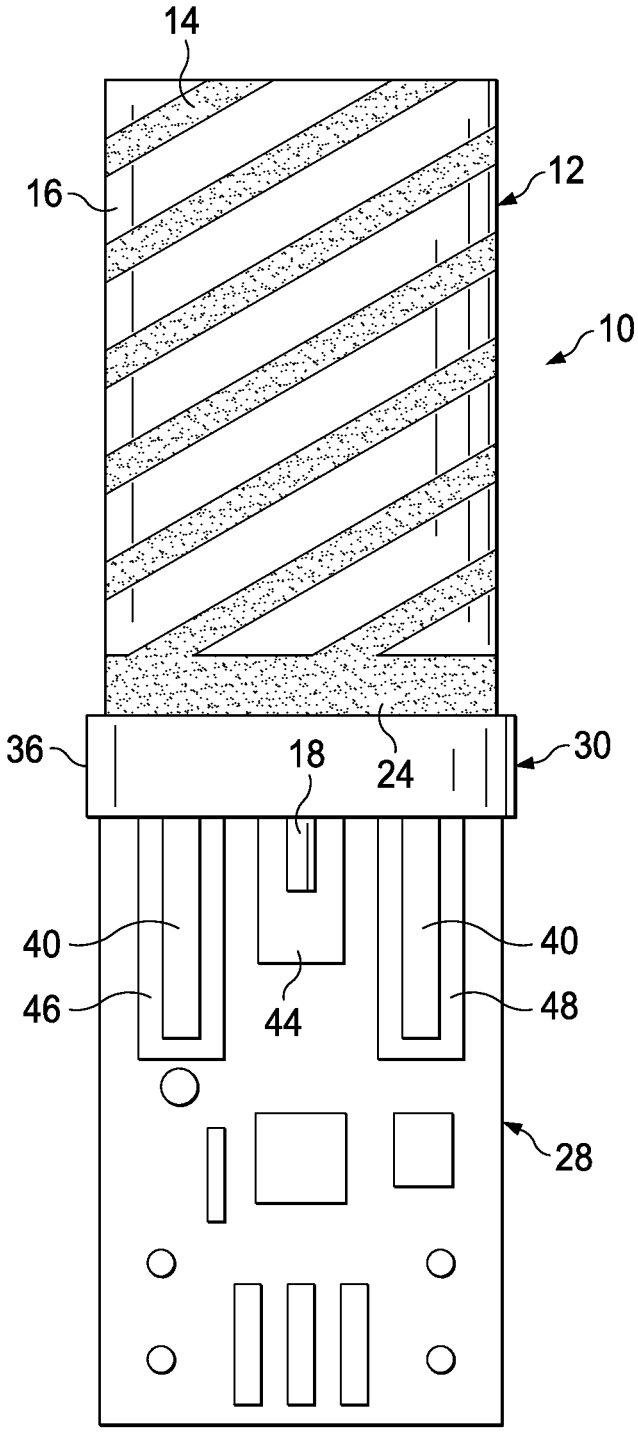
FIG. 5 is a front elevational view of the antenna device of FIG. 1 showing the components of the device assembled together.

Referring to FIG. 5, in use, the proximal end of the antenna body 12 is received and seated in the recess formed by the base 32 and collar 36. The base 32 and collar 36 may be formed of conductive materials so that electrical contact is made with the ground conductor 24 and the ground lugs 26. In certain embodiments, the ground lugs 26 may be bent so that they are generally flush with the proximal end of the antenna body 12 or the lugs or pins 26 may be eliminated since electrical connection may now be made from the ground conductor 24 to the circuit board 28 through the legs or members 38, 40, as is described below. The antenna body 12 may be soldered or otherwise secured to the connector 30, such as with friction fit and/or with the use of an adhesive, which may be an RF conductive adhesive.

The legs 38, 40 of the connector 30 receive the end of the circuit board 28, as shown in FIG. 5, to effectively mount the antenna 10 and connector 30 to the board 28. When so mounted, the legs 38 and/or legs 40 may be positioned to overlay and be in contact with electrical ground pads 46, 48 provided on the board 28. Similarly, the feed pin 18 is aligned with and overlays the pad 44 to facilitate contact to form an electrical connection therewith. The legs 40 may be soldered or otherwise coupled to the pads 46, 48. Likewise the pin 18 may be soldered or otherwise coupled to the pad 44 when assembled.

The legs 38, 40 of the connector 30 facilitate holding and coupling the antenna 10 to the circuit board 28. This is a vast improvement over the prior art methods. As discussed in the background, in prior art antennas, the antennas were coupled to the board directly through the feed pin 18 and ground lugs or pins 26, which were soldered to the pads of the circuit board or coupled to the circuit board through a friction fit connector that is coupled to the circuit board. Without the connector 30, it was often times difficult to hold the antenna in place to ensure that the pins were properly aligned. Additionally, once soldered together, the pins 18 and 26, served as the only means for holding the antenna in place, and were prone to breakage or bending. With the use of the connector 30, the legs 38, 40 provide a stable and substantial coupling means that readily holds the antenna in place without placing stress on the feed pin 18 or pins 26. Additionally, the legs of the connector 30 may be used to provide electrical contact with the ground circuitry of the circuit board and provide a much larger area for electrical engagement. This may even eliminate the need for ground pins or lugs 26 on the antenna. The legs 38, 40 are also not readily prone to breakage or bending as are the ground pins 26 of the prior art antenna systems.

It has also been discovered that the base 32 and collar 36 of the connector 30 provide an additional ground plane that may increase the effectiveness of the antenna. In testing, it has been observed that there may be an increase in the signal-to-noise ratio as compared to the same antenna used without the connecting device.

Figure 6:
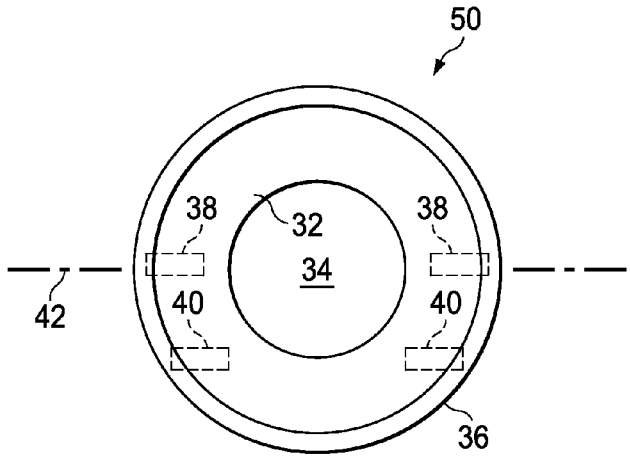
FIG. 6 is a top plan view of another embodiment of an end-mount antenna connector, shown with the legs of the connector in an offset or staggered configuration.
Figure 7:
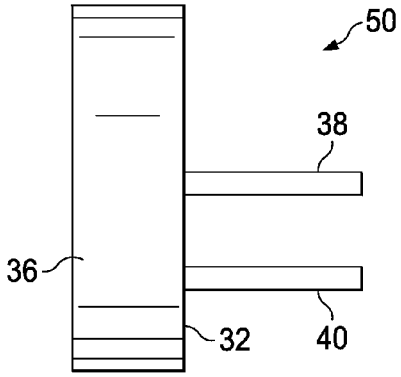
FIG. 7 is an elevational side view of the connector of FIG. 6.
Figure 8:
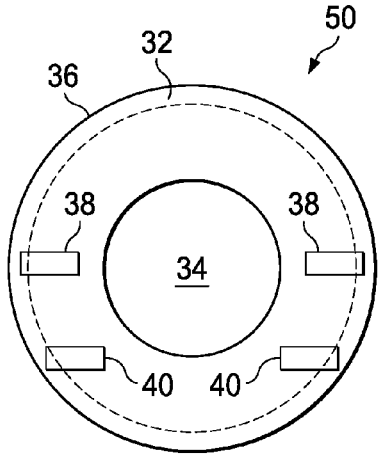
FIG. 8 is a bottom plan view of the connector of FIG. 6.
Figure 9:
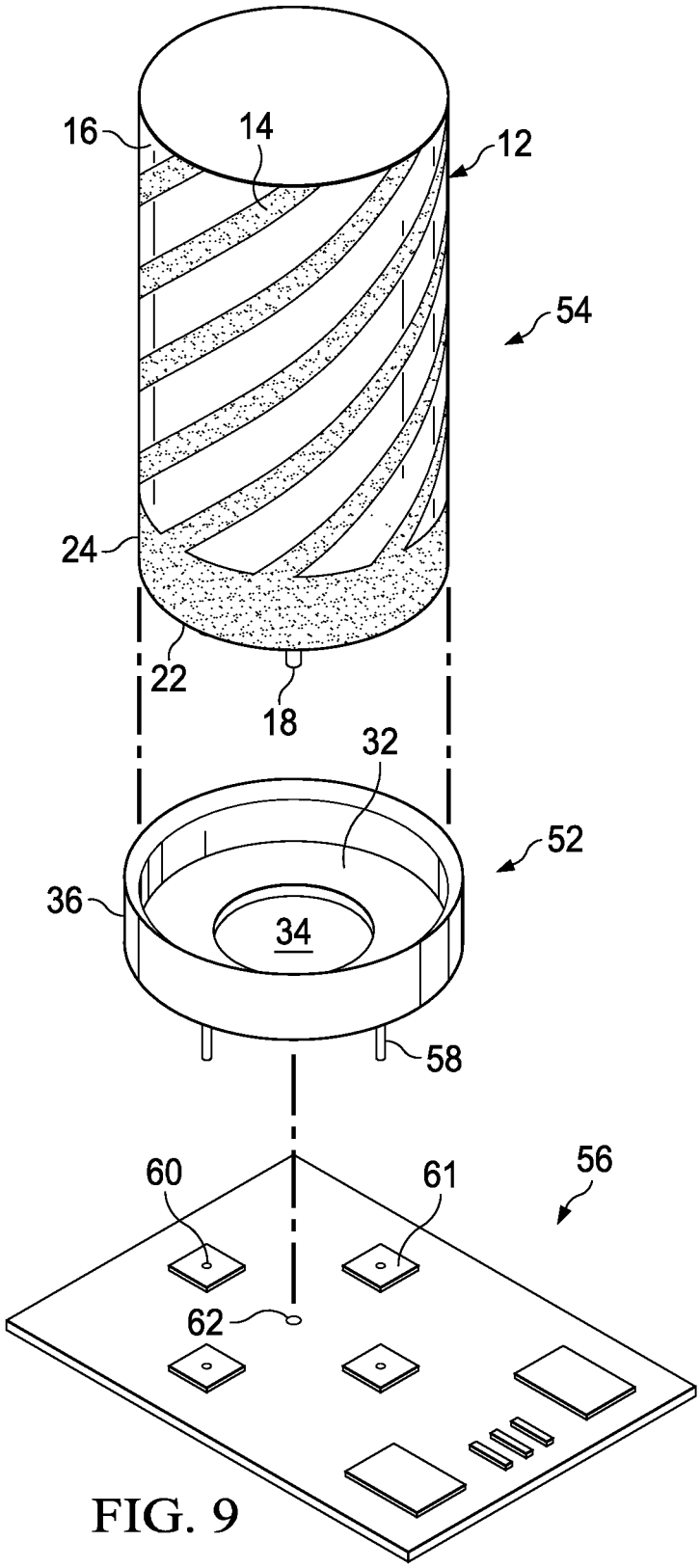
FIG. 9 is an exploded view of another embodiment of an antenna device with a surface-mount antenna connector employing connector projecting pins.
Figure 10:
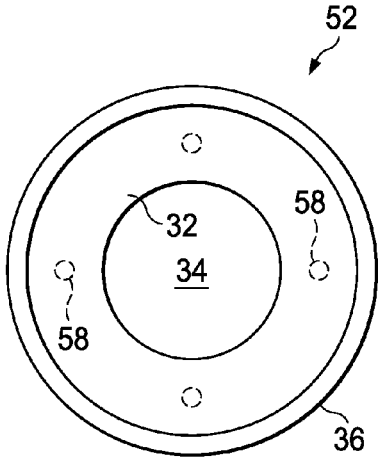
FIG. 10 is a top plan view of the antenna connector of FIG. 9.

Referring to FIGS. 6-8, another embodiment of a connector 50 is shown. The connector 50 is also configured as an end-mount connector and is similar in construction to the connector 30 previously described with similar components designated with the same reference numerals. As shown in FIGS. 6-8, the connector 50 differs from the connector 30 in that the pairs of legs 38, 40 are offset or staggered from one another so that the two legs 38 may be laterally spaced further apart than the two legs 40. Alternatively, the legs 40 may be spaced apart further apart than the legs 38. Other configurations for the spacing of the legs 38, 40 may also be used. The inward faces of the legs 38, 40 may also be located to slightly below the centerline, as with the connector 30. Mounting and use of the connector 50 may be generally the same as that described for the connector 30.

FIGS. 9-12 show another configuration for a connector 52 for use with an antenna 54. The antenna 54 may be similarly configured as the antenna 10, previously described, with similar components being designated with the same reference numerals. Likewise, the connector 52 is similar in construction to the connectors 30 and 50, with similar components being labeled with the same reference numerals. The connector 52 constitutes a surface-mountable connector, which may be a surface-mount connector that mounts to SMT pads and/or a through-hole connector that mounts through through-holes that may be used for mounting an antenna to a circuit board or other structure, such as the circuit board 56. In the embodiment shown, the connector 52 facilitates mounting of the antenna 54 so that the longitudinal axis of the connector 52 or antenna 54 is oriented generally perpendicular to the circuit board 56.

Figure 11:
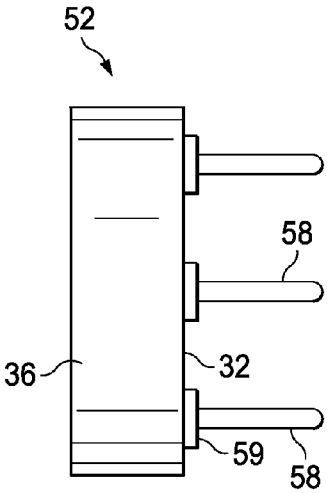
FIG. 11 is a left side view of the antenna connector employing connector pins and surface pad projections.
Figure 12:
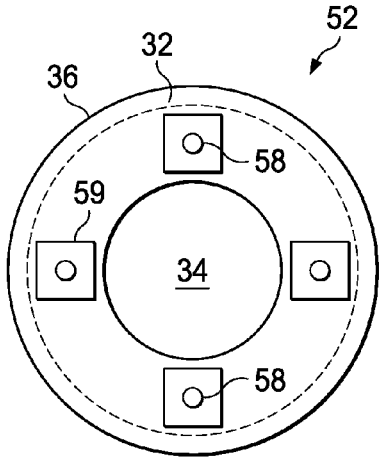
FIG. 12 is a bottom plan view of the antenna connector of FIG. 11.

The connector 52 includes a base 32 having a central opening 34 and a collar 36, which may be configured the same as those of the connector 30. Projecting from the lower surface of the base 32 are connecting pins or projections 58. One or more connecting pins or projections 58 may be used. In the embodiment shown there are four connecting pins or projections 58 that are circumferentially spaced apart at equal intervals and extending generally parallel to the longitudinal axis of the connector 52. Other arrangements and configurations for the pins or projections 58 may also be used. The pins or projections 58 may be formed from a conductive material and may be sized and configured for being received in corresponding holes 60 and/or fit on surface mount pads 61 formed in and on the circuit board 56. The number of pins or projections 58 used may also vary. The connector may also have a combination of connecting pins or projections that are either received in holes 60 or that engage surface mount pads 61. The projections 58 that engage surface mount pads 61 may be shorter, projecting a short distance from the base 32, and have a larger cross section that is sized and configured to facilitate surface mounting to the surface mount pads 61. In certain embodiments, a combination of projections may be used with smaller pins or projections being received within holes 60 to facilitate alignment with larger projections that engage and rest on the surface mount pads 61. FIGS. 11 and 12 show the connector 52 employed with shorter pad projections 59 configured for engaging and cooperating with the surface mount pads 61, with the pin projections 58 being received within holes 60. In other embodiments, the smaller pin projections 58 may be eliminated, with the larger surface area pad projections 59 engaging the surface mount pads 61. In still other embodiments, the pad projections 59 may be eliminated, with the connector 52 employing only the pins 58. The projections 58 and/or 59 may be soldered to the board 56 to fix the connector 52 in place.

Additionally, the circuit board 56 may be provided with a pad or holes 62 for contacting or receiving the feed pin 18 of the antenna 54 that projects through the central opening 34 of the connector 52. With the antenna 54 received in the collar 36, the pins 58 are configured to be received in the holes 60 so that the feed pin 18 is aligned with and received within the hole 62. The holes 60, 62 of the circuit board may be plated or contain a conductive material for electrical contact with the pins 58, 18, respectively. In the embodiment shown, ground pins, such as the ground pins 26 of the antenna 10, are eliminated as electrical contact of the ground 24 of the antenna 54 may be made through the pins 58 of the connector 52.

Figure 13:
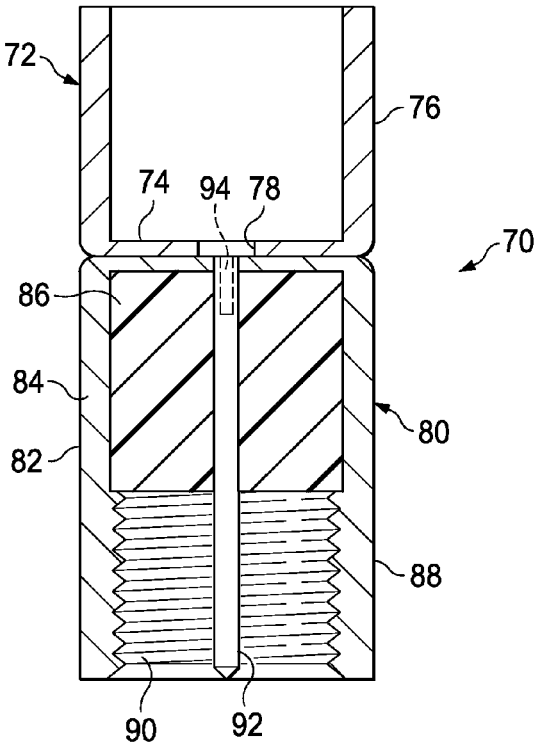
FIG. 13 is a cross-sectional elevational view of a male SMA-type antenna connector.
Figure 14:
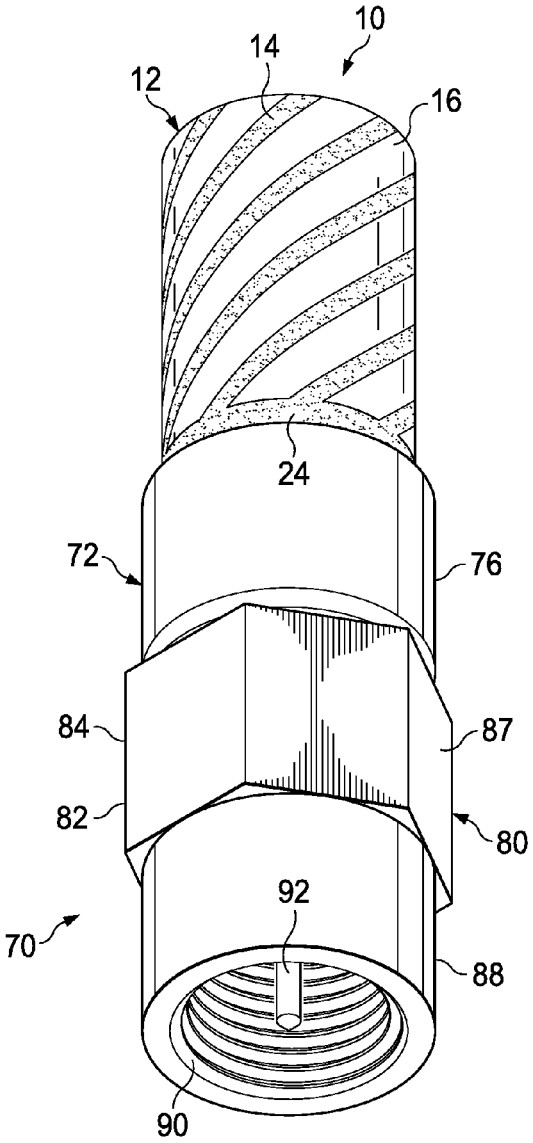
FIG. 14 is an elevational view of the antenna connector of FIG. 13, shown with an antenna mounted to the connector.

FIGS. 13 and 14 illustrate another embodiment of an RF antenna connector 70. The connector 70 is configured as a male SMA connector. The connector has an upper portion 72 that is configured much like the connector 30 previously described and includes a generally flat, circular base 74. A cylindrical wall 76 extends upward generally from the perimeter of the base 74 and forms a collar of the connector 70. The base 74 and collar 76 may be sized and configured to closely receive the proximal end of the cylindrical antenna, such as the circular antenna 10 previously described. Formed in the base 74 is a central opening 78 for receiving the feed pin 18 of the antenna 10.

In the embodiment shown, the lower portion 80 of the connector 70 is configured as a male SMA connector. The SMA connector portion includes a generally cylindrical outer wall 82 that extends from and is joined to the upper portion 72 through the base 74 and/or the collar 76 and may be integrally formed from a continuation of the materials forming the base 74 and collar 76. The upper and lower sections 72, 80 may have generally the same widths or diameters or they may be different. In some embodiments, the lower portion 82 may be formed as separate pieces or sections that are joined to the upper portion 72, such as through welding or other fastening or coupling means. In certain embodiments, the lower portion 80 may be rotatably coupled to the upper portion 72 so that the lower section may be rotated relative to the upper section 72 about its longitudinal axis. This may facilitate threading and unthreading of the connector 70 to a female connector (not shown) or various devices to which the connector 70 may be coupled while the upper portion 72 may be held stationary.

The outer wall 82 of the lower portion 80 includes an intermediate section 84 that may receive and house a dielectric or insulating body 86. The dielectric 86 may be formed from polytetrafluoroethylene (PTFE) or other suitable dielectric material. The exterior of the intermediate section 84 may be provided with nut flats 87 (FIG. 14) or be knurled or otherwise configured so that the intermediate section 84 may be engaged with a tool or wrench or grasped manually to facilitate threading and unthreading of the connector 70.

The lower section 88 of the wall 82 is provided with internal helical screw threads 90, such as those that are commonly used for male SMA connectors, for engagement with a corresponding female connector.

A centrally located connector pin 92 is provided with the connector 70. The connector pin 92 is formed from an electrically conductive material. In the embodiment shown, at its upper end, the pin 92 may be received in the central opening 78 of the base or generally lie just below the central opening 78. An additional insulating sleeve (not shown) may surround exterior of the pin 92, if required. The upper end of the pin 92 is provided with an opening or receptacle 94 and is configured for receiving the feed pin 18 of the antenna 10. The upper portion or half of the pin 92 is encased within the dielectric material 86, with the lower portion of the pin 92 generally coextending with the lower section 88 of the wall 82. The lower end of the pin 92 may be solid with no opening or receptacle and serves as the plug of the male SMA connector for engaging and a cooperating with a female SMA receptacle (not shown) for making electrical contact therewith.

Figure 15:
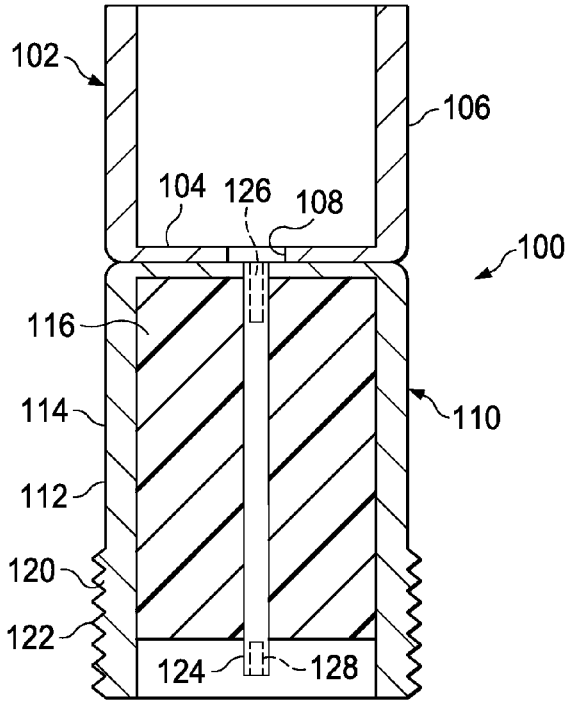
FIG. 15 is a cross-sectional elevational view of a female SMA-type antenna connector.
Figure 16:
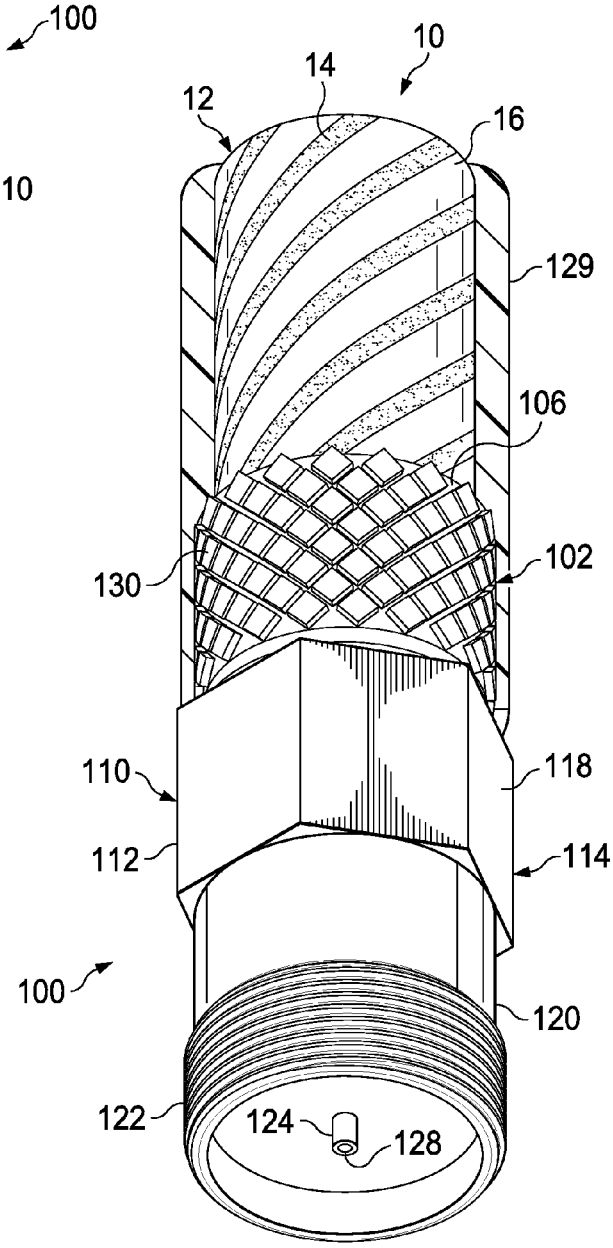
FIG. 16 is an elevational view of the antenna connector of FIG. 15, shown with an antenna mounted to the connector and with an end cover of the antenna in cross section.

FIGS. 15 and 16 show another RF antenna connector 100 that is configured as a female SMA connector. The connector 100 is similar to the male SMA connector 70 and has an upper portion 102 that is configured much like the connector 30 and those previously described. The upper portion 102 includes a generally flat, circular base 104. A cylindrical wall 106 extends upward generally from the perimeter of the base 104 and forms a collar of the connector 100. The base 104 and collar 106 may be sized and configured to closely receive the proximal end of a cylindrical antenna, such as the circular antenna 10 previously described. Formed in the base 104 is a central opening 108 for receiving the feed pin 18 of the antenna 10.

The lower portion 110 of the connector 100 is configured as a female SMA connector. The SMA connector portion 110 includes a generally cylindrical outer wall 112 that extends from and is joined to the upper portion 102 through the base 104 and/or the collar 106 and may be integrally formed from a continuation of the materials forming the base 104 and collar 106. The upper and lower sections 102, 110 may have generally the same widths or diameters or they may be different. In some embodiments, the lower portion 110 may be formed as separate pieces or sections that are joined to the upper portion 102, such as through welding or other fastening or coupling means. In certain embodiments, the lower portion 100 may be rotatably coupled to the upper portion 102 so that the lower section 110 may be rotated relative to the upper section 102 about its longitudinal axis. This may facilitate threading and unthreading of the connector 100 to a male SMA connector (not shown) or various devices to which the connector 100 may be coupled while the upper portion 102 may be held stationary.

The outer wall 112 of the lower portion 110 includes an intermediate section 114. The exterior of the intermediate section 114 may be provided with nut flats 118 (FIG. 16) or be knurled or otherwise configured so that the intermediate section 114 may be engaged with a tool or wrench or grasped manually to facilitate threading and unthreading of the connector 100.

The interior of the lower portion 110 receives and houses a dielectric or insulating body 116. The dielectric 116 may be the same or similar to the dielectric body 86 described for the connector 70.

The lower section 120 of the wall 112 may be provided with external helical screw threads 122, such as those that are commonly used for female SMA connectors, for engagement with internal threads of a corresponding male SMA connector.

A centrally located connector pin or jack 124 (FIG. 15) is provided with the connector 100. The connector pin 124 is formed from an electrically conductive material. In the embodiment shown, at its upper end, the pin 124 may be received in the central opening 108 of the base 104 or generally lie just below the central opening 108. An additional insulating sleeve (not shown) may surround the exterior of the pin 124, if required. The upper end of the pin 124 is provided with an opening or receptacle 126 and is configured for receiving the feed pin 18 of the antenna 10. The pin 124 is encased within the dielectric material 116. The lower end of the pin 124 is also provided with an opening or receptacle 128, as in a conventional female SMA connector, for receiving and engaging a male SMA pin or plug (not shown) for making electrical contact therewith.

FIG. 16 shows the connector 100 with an antenna 10, as previously described, received within the collar 106 of the connector 100. A hollow plastic cap or cover 129 (radome) is shown enclosing the antenna 10 and is coupled to the collar 106. As shown, all or a portion of the outer surface 130 of the collar 106 may be knurled, threaded or otherwise texturized. This facilitates engagement of the cover 129 with the connector 100. With the knurled, threaded or texturized outer surface of collar 106 facilitating secure engagement. This may be with an adhesive or merely a friction fit. The texturized surface of the outer surface 130 may also include helical threads, annular snap rings or recesses formed on the outer surface of the collar that engage a corresponding threads, annular snap recesses or rings formed on the interior of the lower portion of the cover 129.

Other types of connectors may be formed using similar configurations as those previously described. By utilizing the basic design of an antenna connector employing a base and collar, such as the base 32 and collar 36 of the connecter 30, and that may include a central opening with or without the use of an intermediate connector pin, such as the connector pins 92 and 124, various other connectors may be formed. These may include connectors sized and configured as SSMA, TNC, MCX, MMCX, SMB or other RF coaxial connectors.

Figure 17:
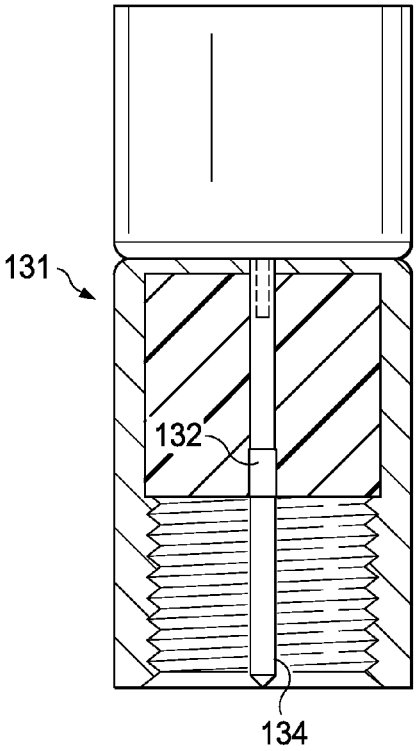
FIG. 17 is a partially cross-sectioned elevational view of an antenna connector employing a DC blocking device within an connector pin of the connector.

Referring to FIG. 17, an antenna connector 131 is shown that is similar to the SMA connector 70 of FIG. 13 previously described. The connector 131 is shown employing a direct current (DC) blocking circuit device or capacitor 132 that is provided with the intermediate connector pin 134 to facilitate blocking of DC signals to the antenna that is coupled to the connector 131.

Figure 18:
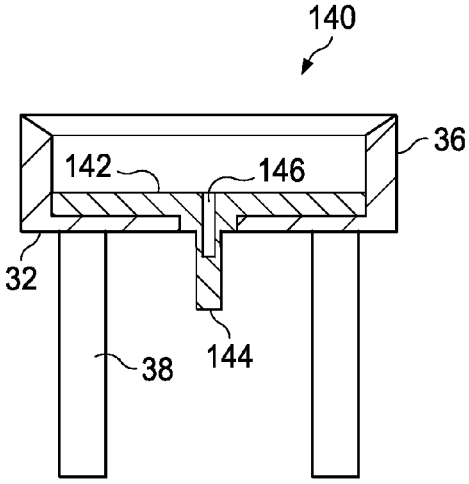
FIG. 18 is cross-sectional elevational view of an antenna connector employing a DC blocking device located within a collar of the connector.

Any of the connectors described herein may be provided with such a DC blocking device. FIG. 18 shows another connector 140 that is similar to the connector 30 previously described, with similar components labeled with the same reference numerals. A DC blocking circuit device 142 that is configured (e.g. circular perimeter) for being received within the collar 36 and rests on the base 32. The board 142 may be provided with its own connector pin 144 having a socket 146 for receiving the feed pin of the antenna that is coupled to the connector 140. The DC blocking device may be provided with the connector 140 or may be added later when the antenna is coupled to the connector. Other configurations of a DC blocking device or capacitor may also be incorporated with the connectors of the invention.

Figure 19:
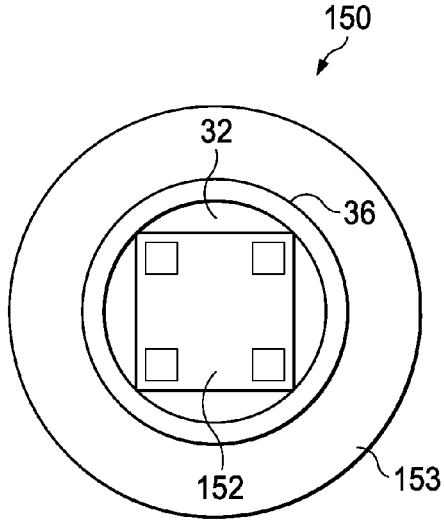
FIG. 19 is a top plan view of an antenna connector incorporating a ground plane with a non-circular antenna received within a collar of the connector.
Figure 20:
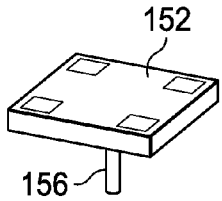
FIG. 20 is a perspective view of a rectangular patch antenna having a feed pin that may be used with the connector of FIG. 19.
Figure 21:
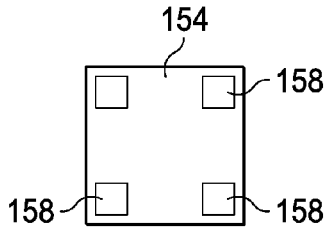
FIG. 21 is a bottom plan view of a rectangular patch antenna having surface-mount pads that may be used with the connector of FIG. 19.

FIG. 19 shows a connector 150 that may be similar to the connectors described herein, such as the connector 30 with similar components being labeled with the same reference numerals. The connector 150 is shown in use with a non-circular RF antenna, such as the square or rectangular patch antennas 152 (FIG. 20) and 154 (FIG. 21). The antenna 152 employs a feed pin 156, while the antenna 154 employs surface-mount pads 158 for making an electrical connection. The connector 150 may be sized and configured with a circular base 32 and collar 36 to receive both circular and non-circular antennas, or may be specifically sized and shaped, such as a square or rectangular base and collar, to closely receive the non-circular antennas. Other non-circular shaped collars and bases (e.g. polygonal) may also be used. The antenna connectors of the invention may be used to hold various fractal antennas.

The connector 150 is also shown with a ground plane 153. The ground plane may be a layer of conductive material, such as copper foil, etc., that is coupled to the connector 150, such as to the underside of the base 32, which may facilitate reflection of RF signals to the RF antenna coupled to the connector.

The connectors described herein may be any size that facilitates securing of the antenna to the device to which it is used. Non-limiting examples of sizes includes those wherein the connector base has a width or diameter of about 5 mm to about 40 mm or about 50 mm or more and wherein the connector collar may have a height of from about 2 mm to about 10 mm. Patch antennas may require a larger width connector base than those used with cylindrical antennas.

The following example serves to further illustrate the invention.

EXAMPLE

GPS antennas employed on identical receiver modules both with and without a connector were tested for RF reception. The receivers used were u-blox™ LEA-4H series receiver modules, available from u-blox, AG, Thalwil, Switzerland. The GPS antennas were Sarantel Geohelix P2 antennas with right-hand circular polarization. The antennas had a tested frequency range of 1603 mHz±60 mHz, a gain of −2.8 dB and 50 ohms impedance. The connector used was that configured as connector 30 shown in FIGS. 1-5, having a base diameter of approximately 11.6 mm, a central opening of 5.5 mm, a collar height of approximately 2.25 mm and a collar thickness of approximately 1 mm. The legs had a thickness of approximately 0.5 mm, a width of approximately 1 mm and a length of approximately 6 mm. The connector was formed of brass with approximately 5 microns of gold flash surface plating.

Two test sets were used where each set had one antenna that was coupled to a receiver module using a connector and another without a connector. In the units employing the connector, the legs of the connector were soldered to ground planes of both sides of the receiver module, with the feed pin of the antenna extending through the central opening and also being soldered to the receiver module. In the units without the connector, the antenna was coupled directly to the receiver module by soldering the feed pin and ground pins of the antenna directly to the receiver module. Tests were then conducted for both antennas side by side in the same RF field and conducted simultaneously. Table 1 below sets forth the results:

TABLE 1

| | Average Signal to Noise Ratio for All Satellites (dB) | Number of All Satellites Read | Average Signal to Noise Ratio for Locked Satellites (dB) | Number of Locked Satellites |
|---|---|---|---|---|
| With Connector | | | | |
| Test Set 1 | 35.00 | 6 | 38.40 | 5 |
| Test Set 2 | 40.22 | 9 | 40.71 | 7 |
| Without Connector | | | | |
| Test Set 1 | 34.57 | 7 | 37.20 | 5 |
| Test Set 2 | 36.44 | 9 | 38.67 | 6 |

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. An antenna system comprising:

an RF antenna having a feed conductor or feed pin extending from a proximal end of the RF antenna:

a device to which the RF antenna couples and for which the RF antenna is used;

and a connector that comprises:

a base having an opening for allowing passage of said feed conductor or feed pin therethrough;

a collar that extends from the base for receiving and coupling to the RF antenna; and a coupling structure that extends from the base and engages the device separately and apart from said feed conductor of feed pin to facilitate coupling of the antenna to the device; and wherein the base and collar are sized and configured to closely receive the proximal end of the RF antenna.

2. The antenna system of claim 1, wherein:

the coupling structure is formed from at least one of (A), (B) and (C), wherein (A) is spaced apart mounting members that project from the base and are configured to engage and receive at least a portion the device between the spaced apart mounting members; B) is connecting projections that are configured for at least one of being received within corresponding holes formed in the device and engaging pads of the device; and (C) is a threaded connector.

3. The antenna system of claim 1, wherein:

the opening is centrally located within the base.

4. The antenna system of claim 3, wherein:

the coupling structure is formed from a pair of spaced apart mounting members that project from the base and are configured to engage and receive at least a portion the device between the spaced apart mounting members, the inward faces of the spaced apart mounting members being located to one side of a centerline of the connector that passes through the center of the central opening.

5. The antenna system of claim 1, wherein:

at least a portion of at least one of the base and collar are formed from electrically conductive materials that are configured for making electrical contact with the RF antenna; and at least a portion of the coupling structure is formed from an electrically conductive material and is in electrical contact with said at least a portion of said at least one of the base and collar.

6. The antenna system of claim 1, wherein:

the connector is configured as one of (A) and (B), wherein is an end-mount connector wherein the connector is configured to couple to the end of a circuit board of the device so that a longitudinal axis of the RF antenna is oriented parallel to a plane of the circuit board, and (B) is a surface-mountable connector wherein the connector is configured to mount to a circuit board of the device so that the longitudinal axis of the RF antenna is oriented perpendicular to the circuit board.

7. The antenna system of claim 1, wherein:

the connector further comprises a DC blocking device to facilitate blocking of DC signals.

8. The antenna system of claim 1, wherein:

the connector is provided with at least one of a connector pin that is separate from said feed conductor or feed pin of the RF antenna and a ground plane.

9. The antenna system of claim 1, wherein:

the connector is configured as at least one of an SMA, SSMA, TNC, MCX MMCX, and SMB connector.

10. A connector for an RF antenna for coupling the RF antenna to a device, the RF antenna having at least one feed pin extending from a proximal end of the RF antenna for electrically coupling the RF antenna to the device through the feed pin, the connector comprising:

a base having a central opening to allow passage of the at least one feed pin of the RF antenna therethrough without the at least one feed pin contacting the connector to allow electrical connection of the feed pin with the device;

a collar that extends from the base for receiving and coupling to the RF antenna; and a coupling structure that extends from the base and engages the device to facilitate coupling of the antenna to the device; and wherein the base and collar are sized and configured to closely receive the proximal end of the RF antenna.

11. The connector of claim 10, wherein:

the coupling structure is formed from spaced apart mounting members that project from the base and are configured to engage and receive at least a portion the device between the spaced apart mounting members.

12. The connector of claim 10, wherein:

at least a portion of at least one of the base and collar are formed from electrically conductive materials that are configured for making electrical contact with the RF antenna; and at least a portion of the coupling structure is formed from an electrically conductive material and is in electrical contact with said at least a portion of said at least one of the base and collar.

13. The connector of claim 10, wherein:

the coupling structure is formed from a pair of spaced apart mounting members that project from the base and are configured to engage and receive at least a portion the device between the spaced apart mounting members, the inward faces of the spaced apart mounting members being located to one side of a centerline of the connector that passes through the center of the central opening.

14. The connector of claim 10, wherein:

the connector is configured as an end-mount connector wherein the connector is configured to couple to the end of a circuit board of the device so that a longitudinal axis of the RF antenna is oriented parallel to a plane of the circuit board.

15. The connector of claim 10, wherein:

the connector is a surface-mountable connector wherein the connector is configured to mount to a circuit board of the device so that the longitudinal axis of the RF antenna is oriented perpendicular to the circuit board.

16. The connector of claim 10, wherein:

the coupling structure is formed from connecting projections that are configured for at least one of being received within corresponding holes formed in the device and engaging pads of the device.

17. The connector of claim 10, wherein:

the coupling structure is a threaded connector.

18. The connector of claim 10, wherein:

the connector further comprises a DC blocking device to facilitate blocking of DC signals.

19. The connector of claim 10, wherein:

the connector is provided with at least one of a connector pin that is separate from said feed conductor or feed pin of the RF antenna and a ground plane.

20. The connector of claim 10, wherein:

the connector is configured as at least one of an SMA, SSMA, TNC, MCX MMCX, and SMB connector.

* * * * *